US011295670B2

(12) United States Patent
Kelly et al.

(10) Patent No.: US 11,295,670 B2
(45) Date of Patent: Apr. 5, 2022

(54) AMBIENT LIGHT SENSING SYSTEM

(71) Applicant: ams AG, Premstaetten (AT)

(72) Inventors: George Richard Kelly, Eindhoven (NL); David Harlow Sin, Eindhoven (NL)

(73) Assignee: AMS AG, Premstaetten (AT)

( * ) Notice: Subject to any disclaimer, the term of this patent is extended or adjusted under 35 U.S.C. 154(b) by 0 days.

(21) Appl. No.: 17/265,125

(22) PCT Filed: Aug. 1, 2019

(86) PCT No.: PCT/EP2019/070801

§ 371 (c)(1),
(2) Date: Feb. 1, 2021

(87) PCT Pub. No.: WO2020/025760

PCT Pub. Date: Feb. 6, 2020

(65) Prior Publication Data

US 2021/0319753 A1 Oct. 14, 2021

Related U.S. Application Data

(60) Provisional application No. 62/713,851, filed on Aug. 2, 2018.

(51) Int. Cl.

| | |
|---|---|
| ***G09G 3/3258*** | (2016.01) |
| ***G09G 5/10*** | (2006.01) |
| ***G09G 3/3233*** | (2016.01) |

(52) U.S. Cl.
CPC ..... *G09G 3/3233* (2013.01); *G09G 2320/064* (2013.01); *G09G 2360/141* (2013.01); *G09G 2360/144* (2013.01)

(58) Field of Classification Search
CPC .... G09G 3/34–3426; G09G 2320/0626–0653; G09G 2310/06–063; G09G 2360/14–148
See application file for complete search history.

(56) References Cited

U.S. PATENT DOCUMENTS

| | | | | |
|---|---|---|---|---|
| 8,933,916 | B1 | 1/2015 | Doar et al. | |
| 9,622,326 | B1 * | 4/2017 | Devyver | G09G 3/3406 |
| 10,997,928 | B1 * | 5/2021 | Wang | G09G 3/3406 |

(Continued)

*Primary Examiner* — Patrick F Marinelli
(74) *Attorney, Agent, or Firm* — Tarolli, Sundheim, Covell & Tummino LLP

(57) ABSTRACT

An apparatus includes a display screen, an ambient light sensor disposed behind the display screen, and an electronic control unit. An integration time of the ambient light sensor is unsynchronized to a frame rate of the display screen. The electronic control unit is operable to control a brightness of the display screen based on a duty cycle of a PWM blanking signal, wherein at least one OFF time of the PWM blanking signal occurs fully within a first integration period of the ambient light sensor, and wherein at least one other integration period ON time of the PWM blanking signal occurs fully during an ON time of the PWM blanking signal. The electronic control unit is further operable to acquire samples of an output of the ambient light sensor, to identify a highest value and a lowest value from among a consecutive group of the samples, and to estimate a magnitude of an ambient light signal based at least in part on the highest value and the lowest value.

12 Claims, 4 Drawing Sheets

(56) References Cited

U.S. PATENT DOCUMENTS

| | | | | |
|---|---|---|---|---|
| 2008/0284176 | A1 | 11/2008 | Fraenkel | |
| 2008/0284716 | A1* | 11/2008 | Edwards | G09G 3/3406 345/102 |
| 2021/0127471 | A1* | 4/2021 | Wang | H05B 47/11 |

* cited by examiner

AMBIENT LIGHT SENSING SYSTEM

RELATED APPLICATIONS

The present invention is a U.S. National Stage under 35 USC 371 patent application, claiming priority to Serial No. PCT/EP2019/070801, filed on 1 Aug. 2019; which claims priority of U.S. Provisional Application Ser. No. 62/713,851, filed on 2 Aug. 2018, the entirety of both of which are incorporated herein by reference.

FIELD OF THE DISCLOSURE

This disclosure relates to ambient light sensing systems.

BACKGROUND

A recent trend in smartphone industrial design is to maximize the screen area by reducing the bezel width and decluttering the remaining bezel area by removing apertures for optical sensors and other holes for microphones, speakers and/or fingerprint reading devices. On the other hand, there also is a trend to increase the number of optical sensors for added functionality. For example, ambient light sensors (ALSs) can be provided to facilitate adjustment of the display screen brightness to the surrounding lighting environment so as to make the display appear sharp and readable while also reducing the display's overall energy consumption.

A further trend in the smartphone market is the adoption of organic light emitting displays (OLEDs). This trend creates an opportunity to move the ALS from the smartphone's bezel to a position under the OLED. OLEDs are generally opaque primarily as a result of a protective film on their backside. This film can be removed in a very small area to allow ambient light to pass through the remaining layers of the OLED to reach the ALS. However, even with the film removed, the OLED is not very optically transmissive, thus requiring a very sensitive sensor to make ambient light detection possible. There is a further complication which makes ambient light detection through an OLED technically challenging. An ALS sensor will detect not only ambient light (e.g., background light, sunlight, etc.) passing through the display, but will also detect the light generated by the display itself. As a result, the display brightness, as driven by the ALS, will fluctuate with changes in the brightness of the pixels directly above the sensor. Such fluctuations are undesirable.

SUMMARY

This disclosure describes portable computing devices and other apparatus that include an ambient light sensor system. The techniques described in this disclosure can be particularly advantageous for situations in which the ambient light sensor is disposed behind a display screen of a host device such that ambient light detected by the sensor passes through the light emitting display before being detected by the sensor.

For example, in one aspect, the present disclosure describes an apparatus that includes a display screen, an ambient light sensor disposed behind the display screen, and an electronic control unit. An integration time of the ambient light sensor is unsynchronized to a frame rate of the display screen. The electronic control unit is operable to control a brightness of the display screen based on a duty cycle of a PWM blanking signal, wherein at least one OFF time of the PWM blanking signal occurs fully within a first integration period of the ambient light sensor, and wherein at least one other integration period ON time of the PWM blanking signal occurs fully during an ON time of the PWM blanking signal. The electronic control unit is further operable to acquire samples of an output of the ambient light sensor, to identify a highest value and a lowest value from among a consecutive group of the samples, and to estimate a magnitude of an ambient light signal based at least in part on the highest value and the lowest value.

The present disclosure also describes a method that includes acquiring samples of an output of an ambient light sensor disposed behind a display screen having a brightness controllable by a duty cycle of a blanking PWM signal, wherein an integration time of the ambient light sensor is unsynchronized to a frame rate of the display screen. The method also includes identifying a highest value and a lowest value from among a group of consecutive ones of the samples, and estimating a magnitude of an ambient light signal based at least in part on the highest value and the lowest value.

Some implementations include one or more of the following features. For example, in some instances, the PWM blanking waveform and the integration time come in and out of phase within a period $P_b$ such that $P_{WTIME}=P_b/[(P_b/P_{PWM})-1]$, where $P_{WTIME}$ is a sum of the integration time and a delay before start of a next integration time of the ambient light sensor, and where $P_{PWM}$ is a period of the PWM blanking signal.

In some implementations, the electronic control unit is operable to estimate the magnitude of the ambient light signal based also on a duration of an integration period of the ambient light sensor and an OFF time of the PWM blanking signal. In some instances, the integration period of the ambient light sensor is less than or equal to a difference between an ON time of the PWM blanking signal and the delay before start of the next integration time of the ambient light sensor. Further, in some instances, the integration time of the ambient light sensor is greater than a sum of the OFF time of the PWM blanking signal and the delay before start of the next integration time of the ambient light sensor.

The electronic control unit can adjust a brightness of the display screen based, at least in part, on the estimated magnitude of the ambient light signal.

The present techniques can be advantageous, for example, in asynchronous systems, in which the integration time of the ambient light sensor need not be synchronized with the frame rate of the display screen. In some cases, the sampling frequency can be slightly different from the display screen frame rate, which allows the sensor's integration time to come in and out of phase with the display PWM blanking time over a relatively short period. This feature, in turn, can allow the sampling time to be increased almost to the full display screen OFF time.

Other aspects, features and advantages will be readily apparent from the following detailed description, the accompanying drawings and the claims.

DETAILED DESCRIPTION

Figure 1:
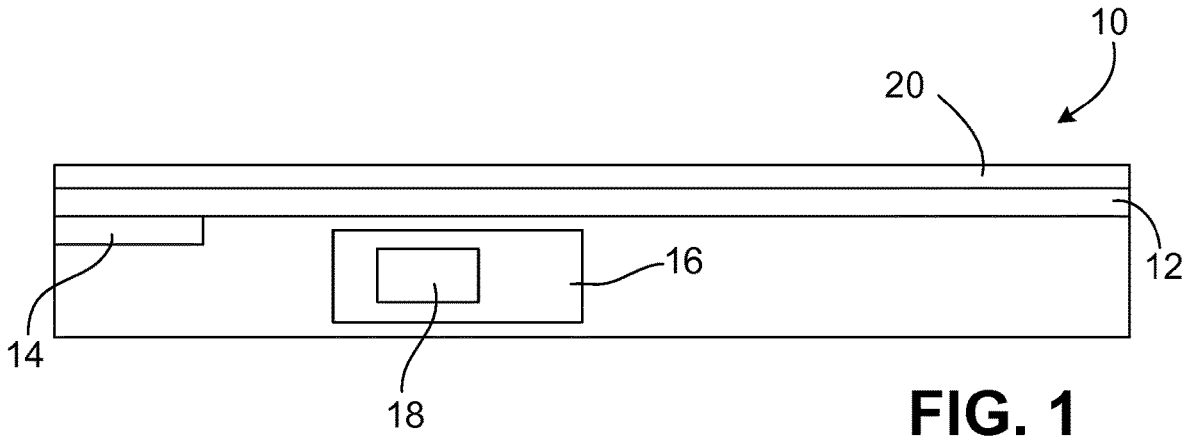
FIG. 1 illustrates various features of a host device that includes an ambient light sensor behind a display screen.

As shown in FIG. 1, a host device 10 such as a portable computing device (e.g., a smartphone, personal digital assistant (PDA), laptop or wearable) includes an OLED-type or other display screen 12, which can be disposed directly under a front glass 20. An ambient light sensor (ALS) 14 is disposed directly under a portion of the display screen 12 and is operable to sense ambient light (e.g., sunlight or other background light). The ALS 14 also may sense light generated by the display screen 12 itself. The ALS 14 can comprise one or more photodiodes or other light sensing elements, each of which is sensitive to a respective wavelength, or range of wavelengths, that may differ from one another. An electronic control unit (ECU) 16 is operable to receive, process and analyze signals from the ALS 14 and to control brightness of the display screen 12. The ECU 16 can be, for example, a processor for the sensor hub or some other processor in the portable computing device 10.

Figure 2:
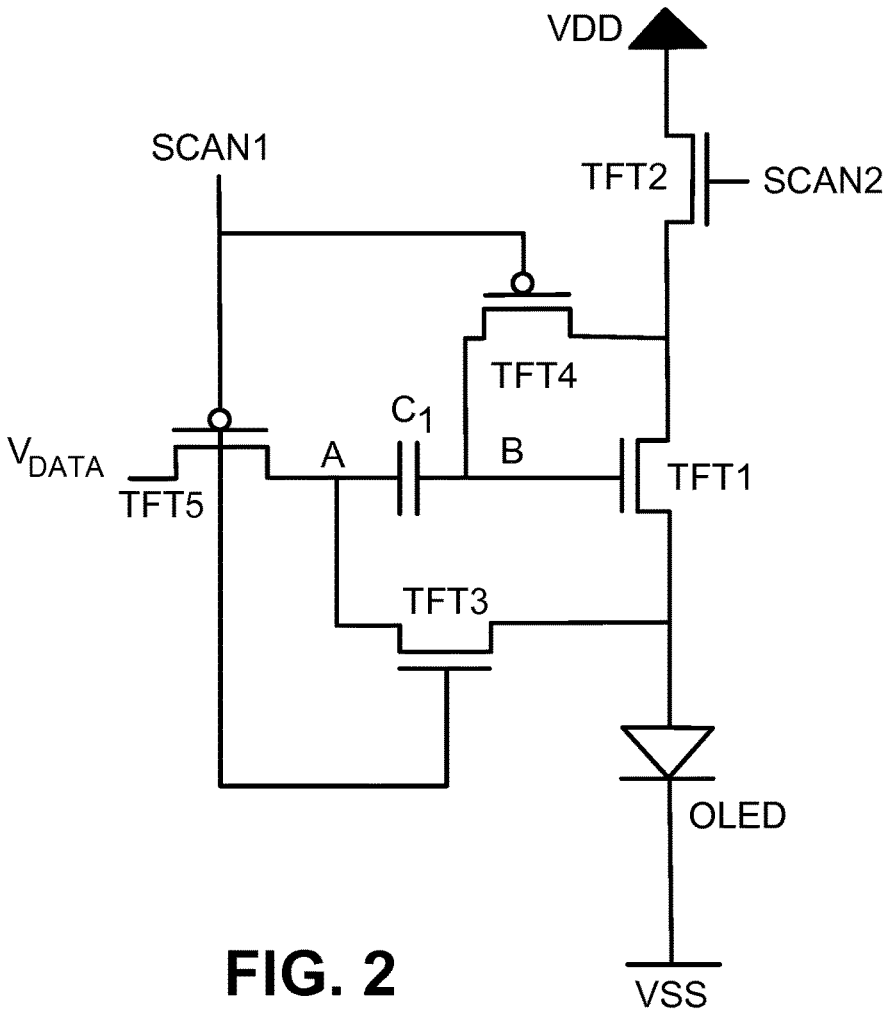
FIG. 2 shows an example of a drive circuit for an organic light emitting display.

Overall brightness of the OLED can be controlled, for example, either by applying PWM modulation of each pixel with a transistor in series with the pixel or by the adjusting the overall range of current that can drive each pixel. FIG. 2 shows an example of an OLED drive circuit for a single OLED pixel. The current that drives each pixel, and therefore the brightness of each pixel, is controlled by a first transistor TFT1 depending on the charge stored on the capacitor Ci. Before each pixel is turned on, the capacitor Ci is charged to the appropriate level, $V_{DATA}$, by setting the voltage SCAN1 to low. Once the voltage SCAN2 becomes high, a second transistor TFT2 turns on and allows current to flow through the OLED pixel as modulated by the first transistor TFT1.

The voltage SCAN2 also is used to apply the PWM modulation to reduce the overall display brightness by applying a square waveform at a multiple of the periodic display frame rate (e.g., a multiple of 60 Hz). The duty cycle of the square wave sets the display brightness. The higher the duty cycle, the more time the PWM blanking signal is ON (i.e., a digital high signal).

In principle, the ambient light signal can be determined by estimating the light contribution from the display screen and subtracting that value from the total measured light signal (i.e., a signal representing the sum of the ambient light and the display screen light). If the duty cycle of the PWM blanking signal is relatively low (e.g., less than 40% in some instances), the duty cycle OFF time of the PWM signal may be long enough to capture the entire sample during the duty cycle OFF time. However, when the duty cycle is relatively high (e.g., 40% or higher in some instances), sampling an output from the ALS 14 during the duty cycle OFF time becomes more difficult because the blanking OFF time of the PWM signal is relatively short. Further, using a shorter integration time to capture the sensor's output samples tends to result in samples that are less reliable.

Figure 3:
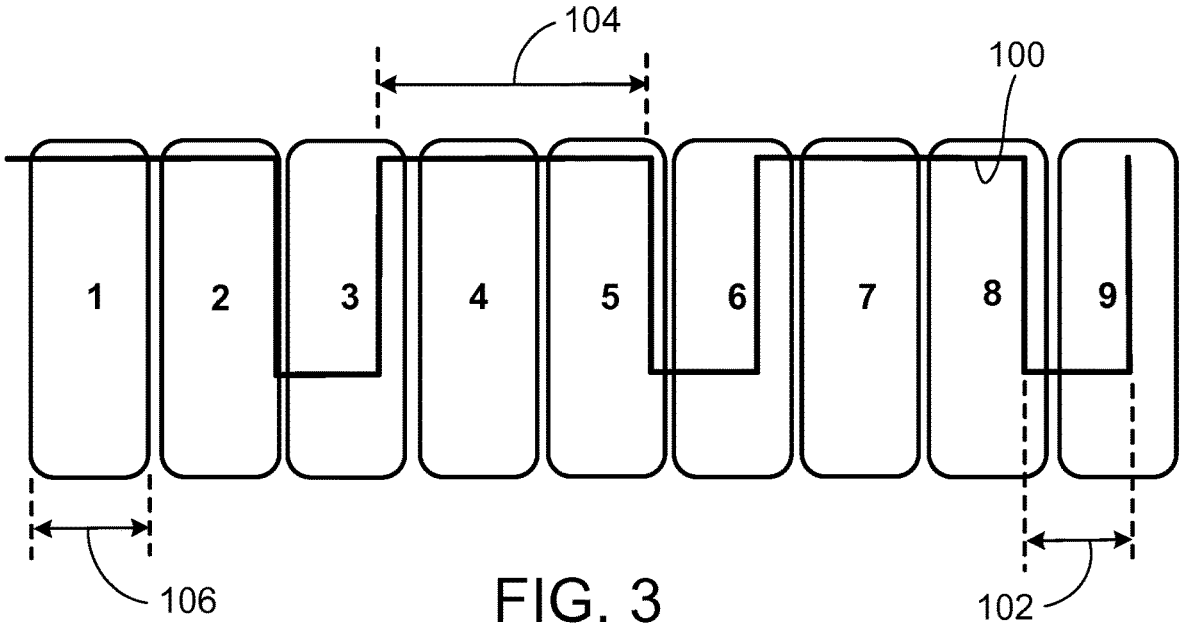
FIG. 3 illustrates an example of PWM blanking signal.

The present disclosure describes asynchronous techniques and systems that facilitate decoupling of the ambient light component from the display screen brightness. In the present context, asynchronous operation means that the integration time of the ALS sensor 14 does not need to be synchronized to the display screen's frame rate. FIG. 3 shows an example of a PWM blanking signal 100 that has an OFF time 102 and an ON time 104. A group of sequential integration times 106 for the ambient light sensor 14 are labeled 1 through 9 in FIG. 3.

The present disclosure describes techniques that use a sampling frequency that is slightly different from the display screen frame rate. This feature means that the integration time will come in and out of phase with the display PWM blanking time over a relatively short period of time and allows the sampling time to be increased to almost the full display off time. To help ensure that the PWM blanking waveform and the integration time will come in and out of phase within a period $P_b$, the following relationship can be applied:

$$P_{WTIME}=P_b/[(P_b/P_{PWM})-1] \quad \text{(Equation 1)},$$

where $P_{WTIME}$ is the sum of the sensor's integration time and a delay (e.g., wait time) before the start of the sensor's next integration time, and where $P_{PWM}$ is the PWM blanking period. In some implementations, the period $P_{WTIME}$ is stored and set by a register. In some instances, for example, the delay time from the end of one integration period to the start of the next integration period is 0.2777 ms. This value may differ for other implementations.

In addition to the foregoing constraint of Equation 1, at least one integration time 106 should occur completely within the PWM ON time 104. Thus, the sensor's integration time 106 should be less than or equal to the difference between the PWM ON time and the delay before the start of the sensor's next integration time. The sample acquired during this integration time measures the sum of the ambient light (A) and the display screen light (D). Further, at least one PWM OFF time 102 should occur fully within another integration time 106. Thus, the sensor's integration time 106 should be greater than the sum of the PWM OFF time and the delay before the start of the sensor's next integration time. As an example, assuming that the PWM period is 4.167 ms and the duty cycle is 90%, then the PWM ON time would be about 3.75 ms. Assuming further that the delay time from the end of one integration time to the start of the sensor's next integration time is 0.2777 ms, then an integration time of (3.75 ms-0.2777 ms)=3.472 ms will meet both of the foregoing constraints.

The ECU 16 can calculate the ambient light level ($A_{ambient}$), for example, using the following relationship:

$$A_{ambient}=[\text{VALUE_}H/(\text{integration time})]-[(\text{VALUE_}H-\text{VALUE_}L)/(\text{blanking OFF time})].$$

The integration time can be set, for example, by software that drives the ALS sensor 14. The blanking OFF time can be calculated, for example, as follows:

$$\text{Blanking OFF time}=(1-d)*(1/f),$$

where d is the duty cycle and f is the PWM frequency (i.e., the inverse of $P_{PWM}$) (e.g., 240 Hz). The ECU 16 can obtain the values for d and f, for example, from a look-up table or by using an equation based on display brightness values stored by the operating system for the host device (e.g., smart phone) in which the sensor 14 is integrated. VALUE_H and VALUE_L are measured values, described further below.

The ECU 16 is operable to read out the integrated signals from the ALS 14 and to store the sampled signals, for example in an array in memory (e.g., RAM) 18. The ECU 16 further is operable to identify the highest and lowest stored values, VALUE_H and VALUE_L, respectively. The high value (VALUE_H) corresponds to a sample for which the blanking PWM signal was ON for the entirety of the integration period. This value thus corresponds to integration of the ALS signal during the blanking ON period only (i.e., when the display screen was ON). Thus, the highest value represents a combination of the ambient light signal and the display screen light. In contrast, the lowest value (VALUE_L) corresponds to a sample for which the integration period encompassed the entirety of a duty cycle OFF time of the blanking PWM signal (i.e., an integration period during which the blanking PWM signal was low for at least part of the integration period).

Using the values for the integration time and the blanking OFF time, as well as the measured values VALUE_H and VALUE_L, the ECU 16 can determine the total ambient light signal over one integration period 100. This value can be divided by the duration of the integration period 100 to obtain the magnitude (i.e., lux) of the ambient light signal.

The ECU 16 can use the magnitude of the ambient light signal to adjust the display screen brightness so as to make the display appear sharp and readable while also reducing the display's overall energy consumption. Thus, the display screen brightness can be adjusted highly accurately in some cases based on the surrounding lighting environment.

In some instances, the ECU 16 reads out and stores N (e.g., sixteen) consecutive samples in the array in memory 18, and then identifies the high and low values (VALUE_H and VALUE_L) after storing the N samples. The ECU 16 then repeatedly performs this process and adjusts the display screen brightness as appropriate based on the calculated magnitude of the ambient light. In other instances, the ECU 16 uses a sliding array in which the oldest sample is removed from the array, and the most recent sample is added to the array. In this mode of operation, the ECU 16 can determine the high and low values (VALUE_H and VALUE_L) as each new sample is measured and stored. The brightness of the display screen 12 then can be updated under control of the ECU 16, as appropriate, more frequently.

Figure 4:
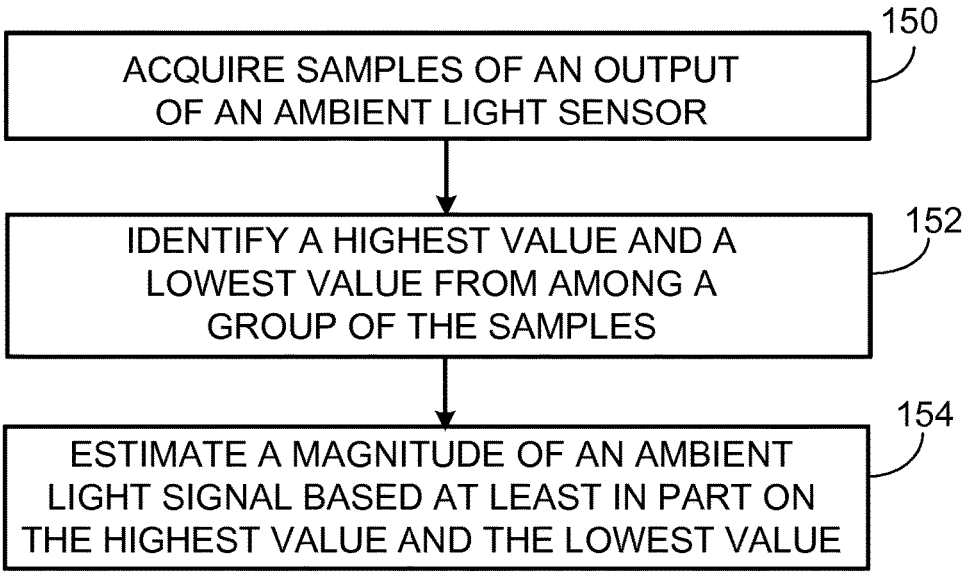
FIG. 4 is a flow chart of a method for determining an ambient light signal.

Thus, as indicated by FIG. 4, the present disclosure describes a method that includes acquiring samples of an output of an ambient light sensor in an asynchronous system in which the integration time of the sensor need not be synchronized to the display screen's frame rate and in which the sensor is disposed behind a display screen having a brightness controllable by a duty cycle of a blanking PWM signal (150). The method includes identifying a highest value and a lowest value from among a group of consecutive ones of the samples (152) and estimating a magnitude of an ambient light signal based at least in part on the highest value and the lowest value (154).

Figure 5:
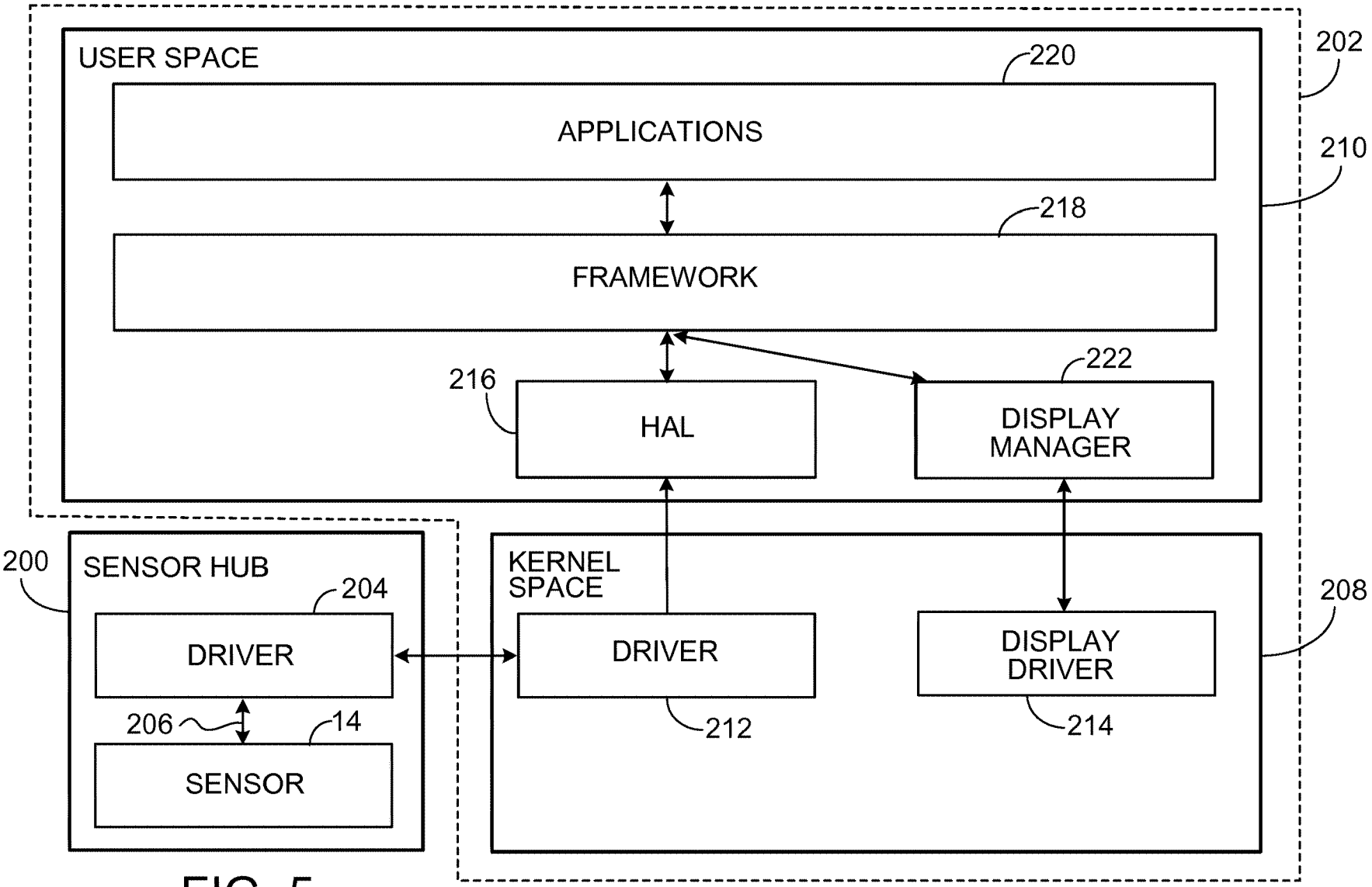
FIG. 5 is a block diagram of an example system.

FIG. 5 illustrates further details according to some implementations. As shown in FIG. 5, a sensor hub 200 includes a driver 204 that controls the ALS 14, which can be coupled to the driver 204 by a bus 206 (e.g., a 400 kbit/s bus). Lux information is calculated from within the sensor hub driver 204.

Various software stacks can be provided across the sensor hub 200 and the application processor 202, which in the illustrated example includes kernel space 208 and user space 210. The kernel space 208 can include a driver 212 that serves as a master to control the sensor hub 200, and a display driver 214. The user space 210 includes a hardware abstraction layer (HAL) 216, a framework layer 218 that has a sensor manager, and an application layer 220.

The lux data can be sent from the sensor hub 200 to the HAL 216 on the application processor 202 by way of the driver 204 and a sensor hub framework (i.e., a software stack into which the driver 204 plugs). The application processor user space 210 includes a display manager 222 operable to use the lux readings to determine the display brightness.

In some implementations, the sensor hub driver 204 implements interrupts or timers to process hardware analog-to-digital (ADC) channel data. As mentioned above, the sensor hub framework is operable to report lux to the application processor, as well as ADC channel data, integration time, and gain settings. Preferably, the sensor hub driver 204 is able to accept configuration parameters during initialization to support system differences.

The display manager 222 should be operable to read lux data from the sensor manager in the framework layer 218. The display manager 222 also should be operable to obtain the current display brightness level, to calculate lux to brightness (or implement an interface to access a lux to brightness algorithm), and to set the brightness level of the display. Preferably, the lux to brightness algorithm is able to accept configuration parameters during initialization to support system differences.

Figure 6:
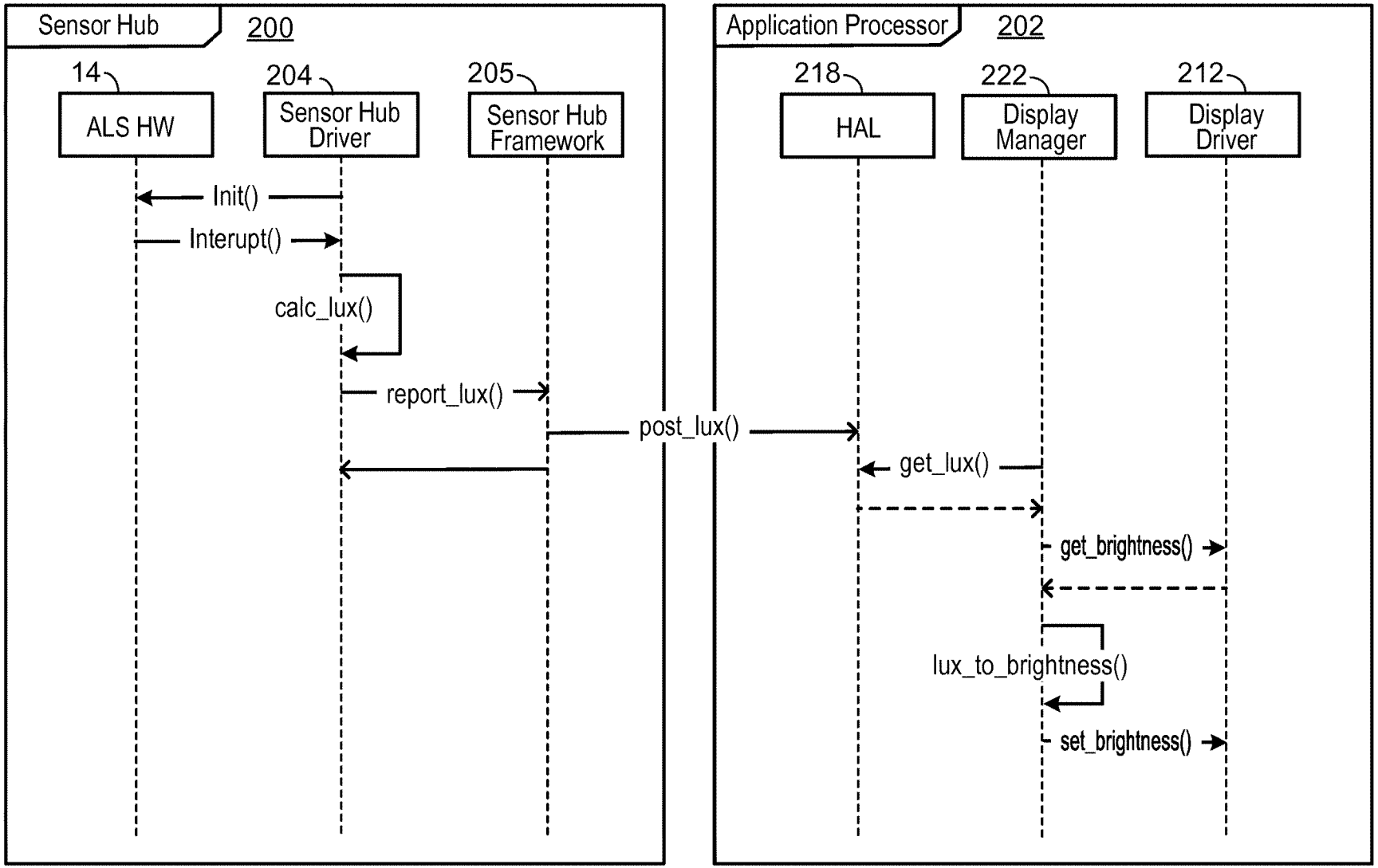
FIG. 6 shows an example of a call sequence.

FIG. 6 illustrates an example of a call sequence using interrupts for the system of FIG. 5. In this example, the sensor hub driver 204 is registered and executes its initialization sequence, which configures the ALS sensor hardware. When a hardware FIFO threshold is met, the sensor hub driver 204 processes converted digital channel data to produce a lux value. The sensor hub driver 204 then reports the lux value to the sensor hub framework 205, and the framework 205 posts the lux calculation to the application processor 202, if reporting thresholds are exceeded. The display manager 222 periodically checks for lux readings, and uses lux readings, along with the current display brightness, to calculate a new display brightness setting. For this purpose, the display manager 222 can access a look-up table or an algorithm in the host device operating system.

Various aspects of the subject matter and the functional operations described in this specification can be implemented in digital electronic circuitry, or in computer software, firmware, or hardware, including the structures disclosed in this specification and their structural equivalents, or in combinations of one or more of them. Thus, aspects of the subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The apparatus can include, in addition to hardware, code that creates an execution environment for the computer program in question, e.g., code that constitutes processor firmware.

A computer program (also known as a program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Accordingly, other implementations are within the scope of the claims.

What is claimed is:

1. An apparatus comprising:

a display screen;

an ambient light sensor disposed behind the display screen, wherein an integration time of the ambient light sensor is unsynchronized to a frame rate of the display screen; and an electronic control unit operable to control a brightness of the display screen based on a duty cycle of a PWM blanking signal, wherein at least one OFF time of the PWM blanking signal occurs fully within a first integration period of the ambient light sensor, and wherein at least one other integration period ON time of the PWM blanking signal occurs fully during an ON time of the PWM blanking signal, wherein the electronic control unit is further operable to acquire samples of an output of the ambient light sensor, to identify a highest value and a lowest value from among a group of consecutive ones of the samples, and to estimate a magnitude of an ambient light signal based at least in part on the highest value and the lowest value, and wherein the PWM blanking waveform and the integration time come in and out of phase within a period Pb such that:

$$P_{WTIME}=P_b/[(P_b/P_{PWM})-1],$$

where $P_{WTIME}$ is a sum of the integration time and a delay before start of a next integration time of the ambient light sensor, and where $P_{PWM}$ is a period of the PWM blanking signal.

2. The apparatus of claim 1 wherein the electronic control unit is operable to estimate the magnitude of the ambient light signal based also on a duration of an integration period of the ambient light sensor.

3. The apparatus of claim 2 wherein the electronic control unit is operable to estimate the magnitude of the ambient light signal based also on an OFF time of the PWM blanking signal.

4. The apparatus of claim 3 wherein the integration period of the ambient light sensor is less than or equal to a difference between an ON time of the PWM blanking signal and the delay before start of the next integration time of the ambient light sensor.

5. The apparatus of claim 3 wherein the integration time of the ambient light sensor is greater than a sum of the OFF time of the PWM blanking signal and the delay before start of the next integration time of the ambient light sensor.

6. The apparatus of claim 1 wherein the electronic control unit is further operable to adjust a brightness of the display screen based, at least in part, on the estimated magnitude of the ambient light signal.

7. A method comprising:

acquiring samples of an output of an ambient light sensor disposed behind a display screen having a brightness controllable by a duty cycle of a blanking PWM signal, wherein an integration time of the ambient light sensor is unsynchronized to a frame rate of the display screen;

identifying a highest value and a lowest value from among a group of consecutive ones of the samples; and estimating a magnitude of an ambient light signal based at least in part on the highest value and the lowest value, wherein the PWM blanking waveform and the integration time come in and out of phase within a period Pb such that:

$$P_{WTIME}=P_b/[P_b/P_{PWM})-1],$$

where $P_{WTIME}$ is a sum of the integration time and a delay before start of a next integration time of the ambient light sensor, and where $P_{PWM}$ is a period of the PWM blanking signal.

8. The method of claim 7 wherein estimating the magnitude of the ambient light signal is based also on a duration of an integration period of the ambient light sensor.

9. The method of claim 8 wherein estimating the magnitude of the ambient light signal is based also on an OFF time of the PWM blanking signal.

10. The method of claim 9 wherein the integration period of the ambient light sensor is less than or equal to a difference between an ON time of the PWM blanking signal and the delay before start of the next integration time of the ambient light sensor.

11. The method of claim 9 wherein the integration time of the ambient light sensor is greater than a sum of the OFF time of the PWM blanking signal and the delay before start of the next integration time of the ambient light sensor.

12. The method of claim 7 including adjusting a brightness of the display screen based, at least in part, on the estimated magnitude of the ambient light signal.

* * * * *